US009216553B2

(12) United States Patent
Hübner et al.

(10) Patent No.: US 9,216,553 B2
(45) Date of Patent: Dec. 22, 2015

(54) PRESSING DEVICE FOR A PRESS AND A ROTARY PRESS

(75) Inventors: Kai Hübner, Ratzeburg (DE); Werner Seifert, Wentorf (DE)

(73) Assignee: Fette Compacting GmbH, Schwarzenbek (DE)

( * ) Notice: Subject to any disclaimer, the term of this patent is extended or adjusted under 35 U.S.C. 154(b) by 0 days.

(21) Appl. No.: 14/116,247

(22) PCT Filed: Apr. 19, 2012

(86) PCT No.: PCT/EP2012/001690
§ 371 (c)(1),
(2), (4) Date: Feb. 20, 2014

(87) PCT Pub. No.: WO2012/152374
PCT Pub. Date: Nov. 15, 2012

(65) Prior Publication Data

US 2014/0178516 A1 Jun. 26, 2014

(30) Foreign Application Priority Data

May 10, 2011 (DE) ..... 10 2011 101 291

(51) Int. Cl.
*B30B 11/08* (2006.01)
*B30B 11/00* (2006.01)

(52) U.S. Cl.
CPC ..... *B30B 11/006* (2013.01); *B30B 11/005* (2013.01); *B30B 11/08* (2013.01)

(58) Field of Classification Search
CPC ..... B30B 11/005; B30B 11/006; B30B 11/08
USPC ..... 425/135–173, 344–345, 422, 182, 193, 425/353, 454; 700/195, 206, 249, 197, 108, 700/212
See application file for complete search history.

(56) References Cited

U.S. PATENT DOCUMENTS

| | | | | |
|---|---|---|---|---|
| 5,151,280 | A | 9/1992 | Arndt et al. | |
| 6,361,302 | B1 * | 3/2002 | Hinzpeter et al. | 425/182 |
| 6,676,863 | B2 * | 1/2004 | Christiaens et al. | 264/39 |
| 7,014,443 | B2 * | 3/2006 | Hinzpeter et al. | 425/167 |
| 7,981,352 | B2 | 7/2011 | Hinzpeter et al. | |
| 8,025,498 | B2 * | 9/2011 | Haase et al. | 425/345 |

FOREIGN PATENT DOCUMENTS

| | | |
|---|---|---|
| DE | 10251387 | 6/2004 |
| DE | 10 2005 040186 | 3/2007 |
| DE | 102005040286 | 3/2007 |
| DE | 102007057791 | 6/2009 |
| EP | 0460295 | 12/1991 |
| JP | 2005-233959 A | 9/2005 |

* cited by examiner

*Primary Examiner* — Joseph S Del Sole
*Assistant Examiner* — Thukhanh T Nguyen
(74) *Attorney, Agent, or Firm* — Vidas, Arrett & Steinkraus

(57) ABSTRACT

The invention relates to a pressing device for a press, in particular for a rotary press, wherein the pressing device is designed to work together with at least one press punch of the press during operation of the press so that the at least one press punch presses material located in a receiver, wherein the pressing device comprises a force measuring device for measuring the force exerted by the at least one press punch on the pressing device, wherein at least one section of the pressing device is moveable between a closed operation position and an opened maintenance position, and wherein the force measuring device in the opened maintenance position is at least partially accessible from outside. The invention also relates to a rotary press.

7 Claims, 1 Drawing Sheet

PRESSING DEVICE FOR A PRESS AND A ROTARY PRESS

CROSS-REFERENCE TO RELATED APPLICATIONS

This application is a U.S. National Stage Application which claims priority to PCT/EP2012/001690, filed Apr. 19, 2012, which claims priority to DE 10 2011 101 291.9 filed May 10, 2011, the entire contents of each of which are incorporated by reference.

STATEMENT REGARDING FEDERALLY SPONSORED RESEARCH

Not applicable

BACKGROUND OF THE INVENTION

The invention relates to a pressing device for a press, in particular for a rotary press, wherein the pressing device is designed to work together with at least one press punch of the press during operation of the press so that the at least one press punch presses material located in a receiver, wherein the pressing device comprises a force measuring device for measuring the force exerted by the at least one press punch on the pressing device.

The invention also relates to a rotary press with a rotor rotatable around a vertical axis, wherein the rotor has an upper and a lower punch guide for upper and lower press punches and a die plate between the punch guides, wherein the press punches work together with receivers of the die plate, furthermore with at least one filling and dosing station as well as with at least one upper pressing device and at least one lower pressing device, which work together with the upper press punches and with the lower press punches during operation.

Such a rotary press is known for example from DE 10 2007 057 791 B4. It comprises upper and lower pressing devices, wherein respectively an upper pressing device and a lower pressing device together form a pressing station. Several pressing stations are provided, for example a pre-pressing station and main pressing station. In the case of a known rotary press, each pressing device comprises a pressing roller, which works together with the punch heads. It is known to assign force measuring devices to the pressing devices. Based on a force measurement performed during a pressing process, conclusions can be made regarding the quality of the produced tablets. The force measuring devices are thereby arranged within the pressing devices and are not accessible from the outside when the press is operating.

It can be required to remove the force measuring devices for example for maintenance or repair. It can also be required to replace an existing force measuring device with another force measuring device, for example when the pressing force area to be captured by the force measuring device changes greatly. This is the case for example when switching between an operating state in which single-layered tablets are pressed to an operating state in which multi-layered tablets are pressed. Considerable pressing force differences also exist between the pre-pressing station and the main pressing station. If, for example, a pressing station previously used as main pressing station is used in an operating mode other than pre-pressing station or vice versa, it may also be necessary to replace the force measuring device. In the case of pressing devices or respectively rotary presses according to the state of the art, this requires a complex disassembly at least of the pressing roller of the respective pressing device or even a comprehensive disassembly of the entire pressing device. Due to the heavy weight of the involved components, especially the pressing roller, this involves much effort for the respective operator. Moreover, this procedure also takes a considerable amount of time.

Based on the explained state of the art, the object of the invention is to enable maintenance, repair or replacement of a force measuring device of a pressing device in a simple and cost-saving manner.

BRIEF SUMMARY OF THE INVENTION

The invention solves the object for one through a pressing device for a press, in particular for a rotary press, wherein the pressing device is designed to work together with at least one press punch of the press during operation of the press so that the at least one press punch presses material located in a receiver of the press, wherein the pressing device comprises a force measuring device for measuring the force exerted by the at least one press punch on the pressing device, wherein at least one section of the pressing device is moveable between a closed operation position and an opened maintenance position, and wherein the force measuring device in the opened maintenance position is at least partially accessible from outside.

The press can be a tablet press, in particular a rotary tablet press, as is generally known. The pressing device according to the invention can be in particular part of a pressing station of the press. For this, at least one upper pressing device and at least one lower pressing device can be provided, which together form a pre-pressing and/or main pressing station of the press. The pressing device has at least one pressing element, for example a pressing roller, which comes in contact with the press punches during the operation of the press and presses it into receivers of the press for material to be pressed, for example die holes. The material can be a powder. It is pressed in the known manner by the press punches into a pellet, for example a tablet. The pressing device according to the invention has a force measuring device also in the known manner. It is used to measure the force exerted during operation between the pressing device, in particular a pressing element, such as a pressing roller, and the press punch(es). From this, conclusions can be made about the quality of the produced pellets.

According to the invention, the pressing device has a section, which is moveable from a closed operating position for the operation of the press into an opened maintenance position for maintenance or the like of the force measuring device. In the opened maintenance position, the force measuring device arranged within the pressing device is accessible for the operator at least partially, in particular completely. A partial or complete removal of the force measuring device can thus take place for maintenance, repair or replacement with another force measuring device. Disassembly of the pressing device, for example of a pressing element, such as a pressing roller, is not required. Rather, it can be made accessible in a simple manner by separating the pressing device in the area of the force measuring device. Maintenance, repair or replacement of the force measuring device is hereby considerably simplified compared to the state of the art both with respect to time and with respect to the force to be applied by the operator.

It can be provided that the moveable section remains connected with the permanently arranged section of the pressing device during its movement between the opened and the closed operating position. For example, if the moveable section does not include a pressing element, in particular if the moveable section does not include a pressing roller, it can also be provided that the moveable section is released from the permanently arranged section in its opened maintenance position. The force measuring device can comprise for example a so-called load cell or respectively a so-called pressure piece and a force sensor, wherein the load cell or respectively the pressure piece is exposed to the occurring forces or respectively pressures during operation and transfer them to the force sensor. It can be sufficient during maintenance, repair or replacement if only the load cell or respectively the pressure piece is removed. It can also be sufficient to only remove the force sensor. It can thus be provided that only the respective part of the force measuring device to be removed is accessible from outside in the opened maintenance position. Of course, it is also conceivable that the entire force measuring device is removed. In this case, the entire force measuring device is accessible from outside in the opened maintenance position of the moveable section of the pressing device.

According to one embodiment, it can be provided that the force measuring device is mainly inaccessible from outside in the closed operating position of the moveable section. Furthermore, it can be provided that the force measuring device is arranged in a receiver of the pressing device. With these embodiments, the force measuring device is optimally protected during the operation of the press.

According to a particularly practical embodiment, the moveable section of the pressing device can be pivotable between the closed operating position and the opened maintenance position, in particular by means of a pivot bearing. For example, the moveable section can be pivotable around a vertical pivot axis or around a pivot axis tilted with respect to a rotational axis of a rotor of the press. The pressing device can have for example an upper and a lower half or respectively housing half, wherein the force measuring device is received between the two halves. The upper or lower half of the pressing device can then be pivoted out of the closed operating position connected with the lower or respectively upper half away from the lower or respectively upper half of the pressing device into the opened maintenance position. The term pivoting thereby also includes a turning of the moveable section of the pressing device with respect to the other, permanently arranged section of the pressing device around a joint central axis or an inner-lying rotational axis. Alternatively, it is also conceivable that the moveable section of the pressing device is shiftable in a translatory manner between the closed operating position and the opened maintenance position.

According to a further embodiment, the pressing device can comprise a pressing roller, which works together with the at least one press punch during operation of the press, wherein the pressing roller is mounted on the moveable section of the pressing device. The pressing element of the pressing device, for example a pressing roller, can be arranged for example on a pivotable upper or lower half Specifically in the case of the normally very heavy pressing rollers, the invention thus offers great advantages since they do not need to be disassembled for access to the force measuring device. Moreover, access to the force measuring device in this embodiment is possible in a particularly easy manner. The force measuring device can be arranged for example in a vertically progressing pressing roller bolt, on the outside of which the pressing roller is fastened. Naturally, it is also possible that the pressing roller is mounted on the non-moveable section of the pressing device.

The invention also relates to a rotary press with a rotor rotatable around a vertical axis, wherein the rotor has an upper and a lower punch guide for upper and lower press punches and a die plate between the punch guides, wherein the press punches work together with receivers of the die plate, furthermore with at least one filling and dosing station as well as at least one upper pressing device and at least one lower pressing device, which work together with the upper press punches during operation, wherein the upper pressing device and/or the lower pressing device is designed in the manner according to the invention described above. The die plate can be designed as one single piece or can consist of individual die segments. The receivers can be so-called die holes. Die casings can be arranged in the die holes. But this is not absolutely required.

BRIEF DESCRIPTION OF THE SEVERAL VIEWS OF THE DRAWINGS

One exemplary embodiment of the invention is explained below in greater detail using figures. They show schematically.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
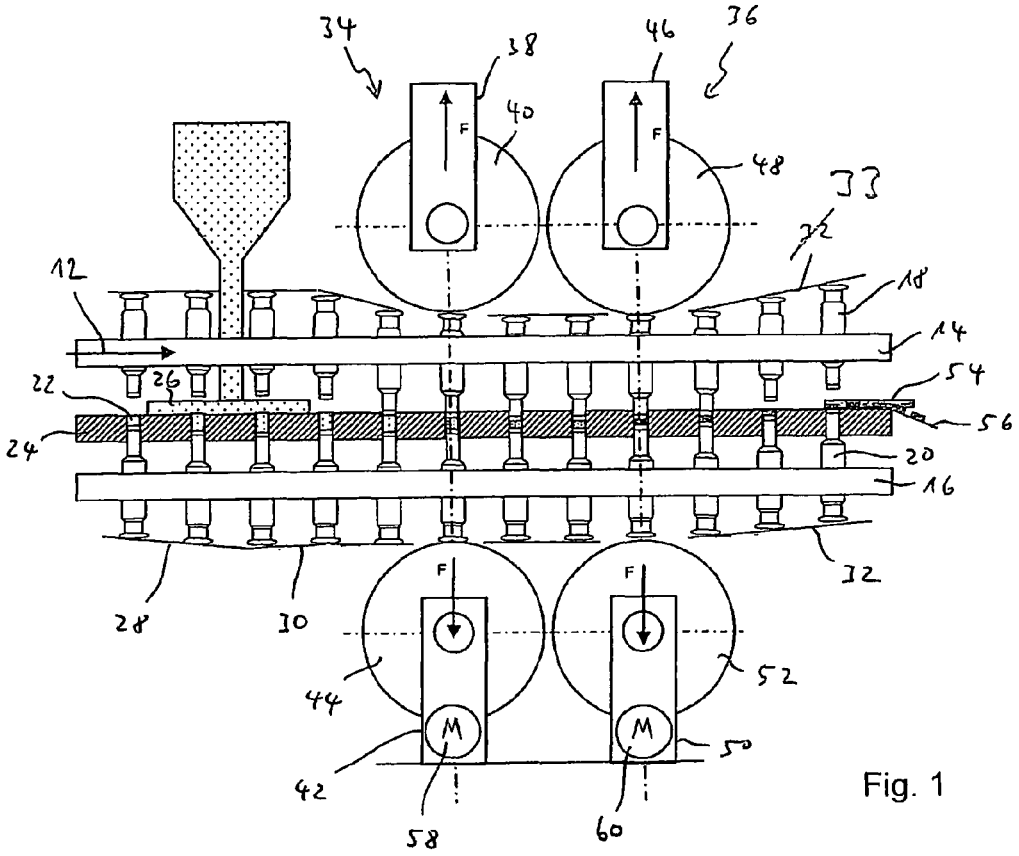
FIG. 1 a part of a rotary press for tablets in a representation unwound into the drawing plane, FIG. 2 a pressing device according to the invention in a first operating state in a perspective view.

FIG. 1 shows the structure of a generally known rotary tablet press. In particular, the rotor of the rotary tablet press is shown, which is rotated by a rotary drive (not shown) around a vertical axis, as shown by the arrow 12. The rotor has an upper punch guide 14 and a lower punch guide 16 for receiving upper punches 18 and lower punches 20 of the press. The upper punches 18 and the lower punches 20 work together with receivers 22 of a die plate 24, here die holes, which is arranged between the punch guides 14, 16. Powdered press material is fed to the receivers 22 via a filling device 26. The filling device 26 is part of a filling and dosing station of the press, which furthermore comprises filling cam elements 28 and dosing cam elements 30. The rotor furthermore comprises lower discharge cam elements 32 and upper lifting cam elements 33.

A pre-pressing station 34 and a main pressing station 36 are arranged downstream in the direction of rotation of the rotor of the filling device 26. The pre-pressing station 34 has an upper pressing device 38 with an upper pressing roller 40 and a lower pressing device 42 with a lower pressing roller 44. The main pressing station 36 also has an upper pressing device 46 with an upper pressing roller 48 and a lower pressing device 50 with a lower pressing roller 52. The upper and lower punches 18, 20 work together with the pressing rollers 40, 44, 48, 52 in a generally known manner in order to press the press material filled in the receivers 22 into tablets. A stripper 54 is located downstream of the pre- and main pressing station 34, 36 in the direction of rotation, which at this point in time feeds tablets pushed by the lower punches 20 onto the surface of the die plate 24 to a tablet discharge 56 in a generally known manner.

The lower pressing devices 42, 50 each comprise a motor-driven drive 58, 60 with which the vertical distance can vary between the upper pressing rollers 40, 48 and the lower pressing rollers 44, 52. As indicated in FIG. 1 by the arrows labelled with the letter F, forces act between the upper or respectively lower punches 18, 20 and the pressing rollers 40, 44, 48, 52 or respectively the pressing devices 38, 42, 46, 50 carrying them during operation of the press. To measure these forces, force measuring devices are arranged in at least a few, preferably all pressing devices 38, 42, 46, 50.

Figure 2:
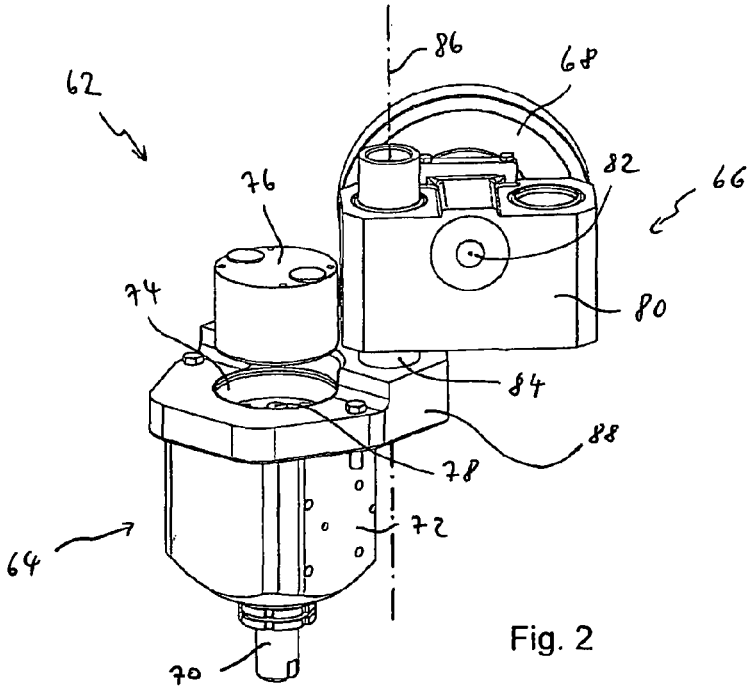

FIG. 2 shows a pressing device according to the invention in a perspective view, which can be provided for the rotary press shown in FIG. 1. A lower pressing device 62 is shown in the example. The pressing device 62 shown in FIG. 2 has a lower half 64 and an upper half 66, which carries the pressing roller 68 in the example shown. The pressing device 62 is supported during operation on a counter bearing via a pressure bolt 70 arranged on the lower half 64. The lower half 64 of the pressing device 62 has a lower housing 72 with a receiver 74 for a pressure piece 76 of a force measuring device. The force measuring device also includes a force sensor 78 that can be seen in FIG. 2 on the bottom of the receiver 74. In the operating position shown in FIG. 2, the pressure piece 76 of the force measuring device is removed from the receiver 74 for illustrative purposes.

The upper half 66 of the pressing device 62 has an upper housing 80, on which the pressing roller 68 is held in a rotatable manner around a horizontal axis 82. The upper housing 80 of the upper half 66 is connected in a pivotable manner with a head part 88 of the lower housing 72 of the lower half 64 around a vertical pivot axis indicated by reference number 86 via a pivot bearing 84. In this manner, the upper half 66 between the opened maintenance position shown in FIG. 2, in which the force measuring device, in particular the pressure piece 76 and the force sensor 78, are accessible for an operator from outside, is pivotable into a closed operating position, in which the force measuring device, in particular the pressure piece 76 and the force sensor 78 are mainly inaccessible from outside.

Through the embodiment of the pressing device 62 according to the invention, access to the force measuring device is possible for maintenance, repair or replacement in a simple manner without the pressing device 62, and in particular its pressing roller 68, needing to be partially or completely disassembled. The two halves 64, 66 of the pressing device 62 remain interconnected at all times via the pivot bearing 84.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. Pressing device for a rotary press, wherein the pressing device (38, 42, 46, 50, 62) is configured to work together with at least one press punch (18, 20) of the press during operation of the press, so that the at least one press punch (18, 20) presses material located in a receiver (22), wherein the pressing device (38, 42, 46, 50, 62) comprises a force measuring device (76, 78) for measuring the force exerted by the at least one press punch (18, 20) on the pressing device (38, 42, 46, 50), characterized in that at least one section (66) of the pressing device (38, 42, 46, 50, 62) is moveable between a closed operating position and an opened maintenance position, wherein the force measuring device (76, 78) in the opened maintenance position is at least partially accessible from outside; wherein:

the force measuring device (76, 78) is arranged in a receiver (74) of the pressing device (38, 42, 46, 50, 62);

the force measuring device in the opened maintenance position is at least partially accessible from outside such that a partial or complete removal of the force measuring device from the receiver (74) can take place for maintenance, repair or replacement with another force measuring device; and the force measuring device (76, 78) in the closed operating position of the moveable section (66) is inaccessible from outside.

2. The pressing device according to claim 1, characterized in that the moveable section (66) of the pressing device (38, 42, 46 50, 62) is pivotable between the closed operating position and the opened maintenance position.

3. The pressing device according to claim 2, characterized in that the moveable section (66) is pivotable around a vertical pivot axis (86) or around a pivot axis tilted with respect to a rotational axis of a rotor of the press.

4. The pressing device according to claim 1, characterized in that the moveable section of the pressing device is shiftable in a translatory manner between the closed operating position and the opened maintenance position.

5. The pressing device according to claim 1, characterized in that it comprises a pressing roller (40, 44, 48, 52, 68), which works together with the at least one press punch (18, 20) during operation of the press, wherein the pressing roller (40, 44, 48, 52, 68) is mounted on the moveable section (66) of the pressing device (38, 42, 46 50, 62).

6. The pressing device according to claim 1, characterized in that it comprises a pressing roller (40, 44, 48, 52, 68), which works together with at least one press punch (18, 20) during operation of the press, wherein the pressing roller (40, 44, 48, 52, 68) is mounted on the non-moveable section of the pressing device (38, 42, 46 50, 62).

7. A rotary press with a rotor rotatable around a vertical axis, wherein the rotor has an upper and a lower punch guide (14, 16) for upper and lower press punches (18, 20) and a die plate (24) between the punch guides (14, 16), wherein the press punches (18, 20) work together with receivers (22) of the die plate (24), furthermore with at least one filling and dosing station as well as with at least one upper pressing device (38, 46) and at least one lower pressing device (42, 50, 62), which work together with the upper press punches (18)

and with the lower press punches (20) during operation, wherein the upper pressing device (38, 46) and/or the lower pressing device (42, 50, 62) is configured according to claim 1.

* * * * *